United States Patent [19]

Harrison et al.

[11] 3,981,789

[45] Sept. 21, 1976

[54] APPARATUS FOR OIL DEWAXING

[75] Inventors: Charles W. Harrison; Herbert J. Pitman, both of Nederland; Glenn A. Senters, Beaumont, all of Tex.

[73] Assignee: Texaco Inc., New York, N.Y.

[22] Filed: Dec. 16, 1974

[21] Appl. No.: 532,961

[52] U.S. Cl. ..... 204/272; 204/184; 204/308

[51] Int. Cl.[2] ..... C25F 7/02; C25F 7/00

[58] Field of Search.... 204/241, 274, 308, 186–191, 204/184, 272, 276, 275; 210/12, 71

[56] References Cited

UNITED STATES PATENTS

| | | | |
|---|---|---|---|
| 1,940,654 | 12/1933 | Stanton | 204/184 |
| 1,968,239 | 7/1934 | Adams | 210/71 |
| 2,025,243 | 12/1935 | Jackson et al. | 204/147 |
| 2,039,636 | 5/1936 | Dillon et al. | 204/184 |
| 2,303,721 | 12/1942 | Brandt | 210/71 |
| 2,337,385 | 12/1943 | Gross | 210/71 |
| 3,862,022 | 1/1975 | Hermann | 204/272 |

*Primary Examiner*—T. M. Tufariello

*Attorney, Agent, or Firm*—Thomas H. Whaley; Carl G. Ries; Henry C. Dearborn

[57] ABSTRACT

A method of dewaxing oil which employs the application of reversing electromotive force to the oil while it is being chilled, in order to prevent adherence of the wax crystals.

An apparatus combination for dewaxing oil. It includes an elongated container for chilling a body of waxy oil as it flows through. The container acts as one of a pair of electrodes for applying a reversable electromotive force to the oil in order to prevent any adherence. The wax may be recovered by separation following the application of the electrical force.

1 Claim, 4 Drawing Figures

FILTER
16
13
25
21
18
11
17
22
26
12
30
34
31
35
40
41
42

4
4

APPARATUS FOR OIL DEWAXING

BACKGROUND OF THE INVENTION

1. Field of the Invention

This invention concerns oil-dewaxing, in general. More specifically, it relates to a method and apparatus for improving the procedure of removing waxy constituents from lubricating oil stock.

2. Description of the Prior Art

While there has been a theoretical study made which included electrical effects related to the problem of paraffin deposition, it was a thesis based on laboratory and microscope observations. Additionally, the prior art has not dealt with oil-dewaxing which employed a reversing electrical field to prevent adherence of wax to a chilled surface. Heretofore, commercial dewaxing procedures have made use of chillers with mechanical scrapers in order to remove wax from the walls of the chiller equipment. Such procedure causes crystal deformation which, in turn, causes significant reduction in the filter rate as the wax is being separated from the solution.

Consequently, it is an object of this invention to provide an improved method for dewaxing oil.

Also, it is an object of this invention to provide an apparatus combination for carrying out the method. Such a combination acts to dewax lubricating oils without the need for any mechanical scraping to recover the wax.

SUMMARY OF THE INVENTION

Briefly, this invention concerns a method for dewaxing oil containing some waxy constituents. It comprises the steps of chilling said oil and applying a reversing electromotive force to said oil to assist in coagulating said wax while preventing adherence thereof. And, it also comprises the step of separating said coagulum from said oil.

Again, briefly, the invention concerns apparatus for dewaxing oil containing some waxy constituents, which comprises in combination an elongated cylindrical container for said oil having an inlet and an outlet for permitting said oil to flow therethrough. The said container is constructed of electrically conductive material and forms an electrode for applying an electromotive force to said oil flowing therein. Another electrode is formed by an axially located electrically conductive shaft extending through said container. It also comprises a plurality of thin helical surfaces alternately twisted in opposite rotations and filling said container from said inlet to said outlet for mixing said oil as it flows through. The said helical surfaces are constructed of electrically insulating material. The invention also comprises circuit means for connecting said electromotive force to said two electrodes including switch means for periodically reversing the polarity thereof, and a jacket surrounding said container for circulating a coolant therein. It also comprises filter means for separating said waxy constituents following crystallization thereof.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings, wherein.

DESCRIPTION OF THE PREFERRED EMBODIMENTS

Figures 1, 2, 3, 4:
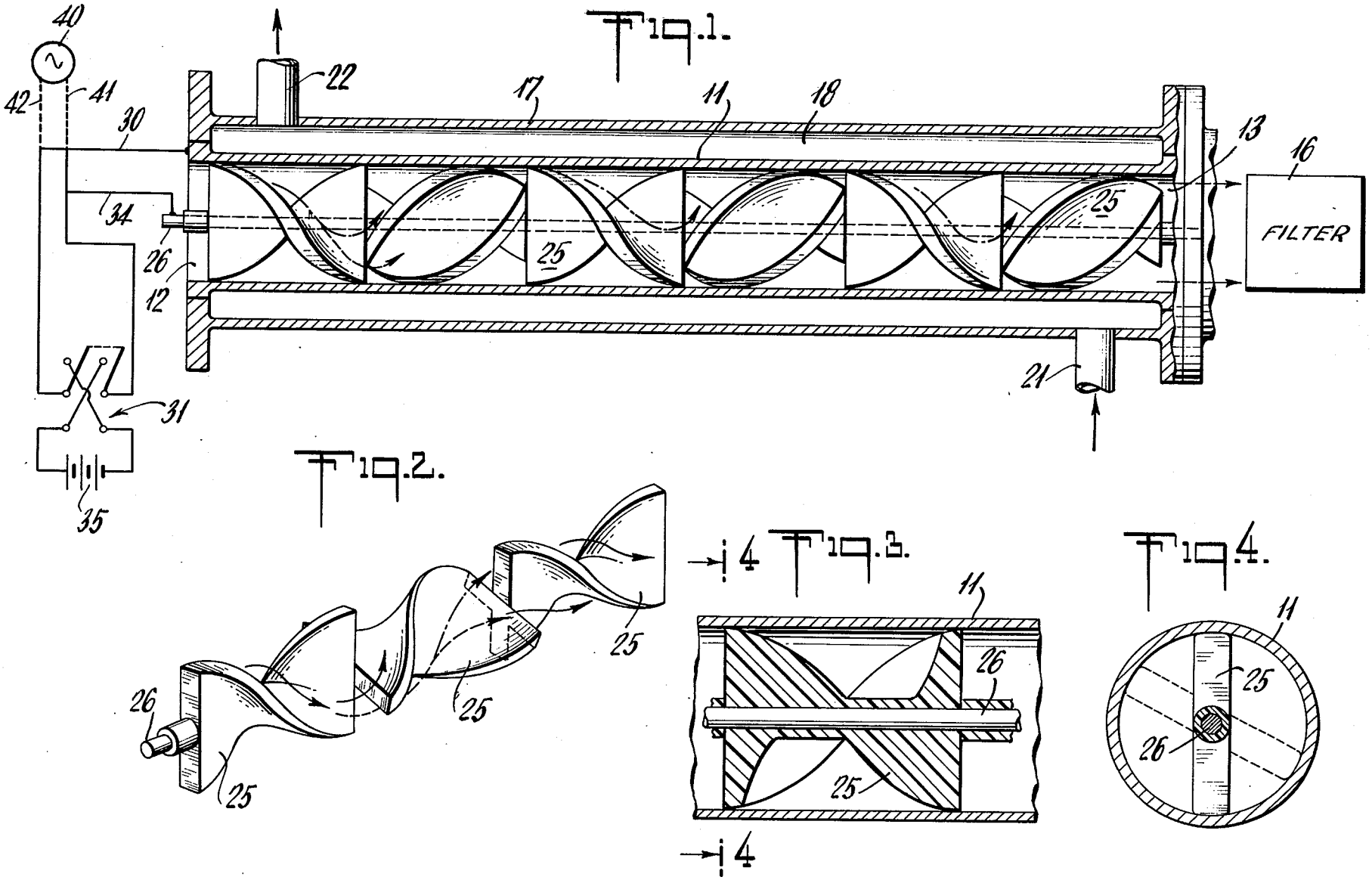
FIG. 1 is a schematic cross-section illustrating a preferred apparatus for carrying out the invention.
FIG. 2 is a perspective view showing part of the mixing vanes that are located in the central chamber of the FIG. 1 apparatus.
FIG. 3 is an enlarged detail cross-sectional view showing one of the helical mixing vanes in relation to a central shaft.
FIG. 4 is a transverse cross-sectional view taken along the lines 4 — 4 of FIG. 3.

Heretofore it has been observed that application of an electrical field to waxy oils tends to produce various effects on the formation of wax crystals which may form from waxy constituents in such oils. However, such observations were carried out with strictly laboratory-type equipment and related to theoretical developments. Furthermore, while it has been proposed to apply an electrostatic field in the dewaxing of oil, that was for the purpose of creating an adherence of the wax which was then scraped free.

Referring to FIGS. 1–4, a preferred apparatus combination will be described, along with some indication as to the method which may be carried out.

Thus, there is a cylindrical container 11 that is made of an electrically conductive material, e.g., an appropriate metal, and which has an inlet 12 at one end plus an outlet 13 at the other end. It will be observed that these are open ends of the container 11 which may be connected to appropriate conduits (not shown) for carrying the oil into and out of the container 11 during the dewaxing procedure.

The oil to be dewaxed will be introduced into the inlet 12 and will flow through the container 11, with mixing therein, until it goes out the outlet 13. As already indicated, the outlet 13 is connected by any convenient conduit (not shown) to a filter 16. This filter 16 may take any appropriate form, and it will act to separate the wax crystals that have formed within container 11 as the waxy oil flows therethrough.

Surrounding container 11, there is a jacket 17 that forms an enclosed annular space 18 around the container 11 for containing a cooling fluid (not shown) which will act as a coolant for chilling the oil flowing through the container 11. In order to circulate such cooling fluid through the space 18 within jacket 17, there is a coolant-inlet pipe 21 and an outlet pipe 22.

Located inside the container 11, and extending all the way from the inlet 12 to the outlet 13, there are a plurality of thin helical vanes or surfaces 25 each of which forms a full rotational twist of 180°. The individual surfaces thus formed are alternately situated at 90°to one another so that the flowing oil which passes through the container 11, is thoroughly mixed by twisting and rotating in opposite directions as each helically surfaced vane is traversed. This much of the structure, per se, is not unique to this invention. Such mixing structure is commercially available from the manufacturer Kenics Corporation, located at Danvers, Mass.

It will be appreciated that the vanes 25 are not necessarily situated at right angles to one another. Other angular relationships might be employed if desired, as is indicated by the FIG. 4 illustration.

In order to adapt the structure of the above-described mixer to this invention, the helical surfaces 25 are constructed of an electrically insulating material. Also, they have an axially located shaft 26 that is constructed of an electrically conductive material. It will be noted that the shaft 26 is completely encased within the thickness of the helical surfaces, although this is not necessarily required. In fact, it may be preferable to have at least part of the surface of the shaft 26 in contact with the oil. The container 11 and the shaft 26, respectively, make up the individual ones of a pair of electrodes to which electromotive force will be applied.

The application of an electromotive force may be accomplished in any feasible manner. A schematic circuit diagram is illustrated in FIG. 1 which indicates a circuit connection 30 that leads from the container 11 to one pole of a double-pole double-throw switch 31. The other pole of switch 31 is connected via a circuit connection 34 to the other electrode i.e., the shaft 26. It will be appreciated that the amplitude of the emf may be quite large so that the use of a battery in the illustrations is entirely schematic.

There is a DC source of electromotive force, e.g. (schematically), a battery 35, that is connected to one pair of the contacts of switch 31 to which the poles may be thrown. There is a conventional cross-connection from these contacts to the other pair of contacts that will be engaged when the poles are thrown to the opposite position.

It will be understood from the foregoing that the DC electromotive force supplied by battery 35 may be reversed in polarity when it is applied to the electrodes 11 and 26. It may also be noted that, under some circumstances, the electromotive force may be AC, instead of DC. In case AC is employed, there would be an AC generator 40 that would have output connections 41 and 42 (dashed lines) connected to the electrodes 26 and 11, respectively, instead of the DC circuit connections.

METHOD AND OPERATION

It will be understood that the method according to this invention comprises the following steps which may not necessarily be carried out in the order recited.

First, there is a step of applying a reversing electromotive force to a body of oil which contains some waxy constituents. This step will be carried out by the electrical circuit arrangements indicated. These arrangements include the alternative specifically illustrated in FIG. 1 relating to the use of AC or DC current as the electromotive force.

It is contemplated that periodic reversal of the polarity of the DC EMF might be made at various time intervals. This may be dependent upon one or more of the factors that effect the crystallization and/or migration of the wax in the oil under treatment. Also, the amplitude of the voltage applied may be varied so as to be more effectual with some oil stocks than with others.

And, it is also contemplated that whether or not AC EMF is employed may depend upon the particular oil stock being dewaxed.

It will be understood that included in carrying out this step is the necessity of providing electrodes having sufficient surface in contact with the body of oil to permit effective application of the electrical field created by the electromotive force.

Another step is that of chilling the oil. It will be understood that this may be done at the same time as the previous step. The chilling is done by circulating a cooling fluid through the annular space under the jacket 17 as was indicated above.

A final step of the method is that of separating the waxy constituents after application of the electromotive force. Such step may, of course, be carried out in various ways. For example, in the FIG. 1 modification, there is the filter 16 to separate the wax crystals after the oil and wax have left the outlet 13 of the container 11.

Whenever DC electromotive force is being employed in the dewaxing method, it is contemplated that the polarity reversal may be done using a length of time and a potential that is employed which may be different for different oils that are dewaxed.

While particular embodiments of the invention have been described above in considerable detail in accordance with the applicable statutes, this is not to be taken as limiting the invention but merely as being descriptive thereof.

We claim:

1. Apparatus for dewaxing oil containing some waxy constituents, comprising in combination, an elongated cylindrical container for said oil having an inlet and an outlet for permitting said oil to flow therethrough, said container being constructed of electrically conductive material and forming an electrode for applying an electromotive force to said oil flowing therein, another electrode being formed by an axially located electrically conductive shaft extending uninterruptedly through said container, a plurality of thin helical surfaces alternately twisted in opposite rotations and filling said container from said inlet to said outlet for mixing said oil as it flows through, said helical surfaces being constructed of electrically insulating material and covering said conductive shaft, circuit means for connecting said electromotive force to said two electrodes including switch means for periodically reversing the polarity thereof, a jacket surrounding said container for circulating a coolant therein, and filter means for separating said waxy constituents following crystallization thereof.

* * * * *